US007743569B1

(12) United States Patent
Schwalenberg

(10) Patent No.: US 7,743,569 B1
(45) Date of Patent: Jun. 29, 2010

(54) SUPPORT PANEL FOR THIN BRICK

(76) Inventor: Chester Schwalenberg, 504 New Britain Ave., Newington, CT (US) 06111

( * ) Notice: Subject to any disclaimer, the term of this patent is extended or adjusted under 35 U.S.C. 154(b) by 772 days.

(21) Appl. No.: 11/117,135

(22) Filed: Apr. 28, 2005

Related U.S. Application Data

(60) Provisional application No. 60/567,059, filed on Apr. 30, 2004.

(51) Int. Cl.
*E04F 13/14* (2006.01)

(52) U.S. Cl. ..... 52/387; 52/288.1; 52/389; 52/386

(58) Field of Classification Search ..... 52/384–387, 52/288.1, 389, 509–510, 506.01, 506.03, 52/506.04, 506.05, 506.06, 506.08, 478, 52/323, 550, 222, 318–321, 513
See application file for complete search history.

(56) References Cited

U.S. PATENT DOCUMENTS

| | | | | | |
|---|---|---|---|---|---|
| 421,742 | A | | 2/1890 | Marsh | |
| 520,137 | A | | 5/1894 | Deslauriers | |
| 802,727 | A | | 10/1905 | Altschuler | |
| 874,909 | A | | 12/1907 | Fischer | |
| 1,555,414 | A | | 9/1925 | Hale | |
| 1,946,690 | A | | 2/1934 | Haines | |
| 2,003,996 | A | * | 6/1935 | Finzer et. al. | 52/482 |
| 2,022,363 | A | * | 11/1935 | Vertuno | 52/386 |
| 2,043,706 | A | * | 6/1936 | Myers | 52/387 |
| 2,054,511 | A | | 9/1936 | Hornicek | |
| 2,066,268 | A | * | 12/1936 | Hohner | 52/275 |
| 2,087,931 | A | | 7/1937 | Wallace et al. | |
| 2,101,612 | A | | 12/1937 | Duffy | |
| 2,132,547 | A | | 10/1938 | Sohn | |
| 2,200,649 | A | | 5/1940 | Wardle | |
| 2,213,355 | A | | 9/1940 | Woodworth | |
| 2,300,258 | A | | 10/1942 | Kubianow | |
| 2,317,428 | A | | 4/1943 | Anderson | |
| 2,791,117 | A | | 5/1957 | Bailey | |
| 2,832,102 | A | | 4/1958 | Amoruso | |
| 2,919,572 | A | | 1/1960 | Salzi | |

(Continued)

OTHER PUBLICATIONS

Dictionay definition of tab from Kernerman English Multilingual Dictionay.*

*Primary Examiner*—Jeanette Chapman
(74) *Attorney, Agent, or Firm*—Hoffberg & Associates

(57) ABSTRACT

A support panel for thin brick, comprising a metal sheet, an array of groove retaining tabs having first tab edges, said first tab edges protruding from said sheet having at an upward angle of less than about 45 degrees, for a distance of less than about one quarter inch, and an array of mortar lock tabs having second tab edges, said second tab edges protruding from said sheet at a downward angle of greater than about 45 degrees, said array of mortar lock tabs being offset vertically from said array of groove retaining tabs, wherein, said array of groove retaining tabs are adapted to engage shallow dove-tail grooves formed in the rear of thin bricks, and said mortar lock tabs are adapted, when embedded within a cured mortar matrix, to exert, in response to a tensile force away from said metal sheet, a force along a vertical axis, on the brick, in an opposite direction to a force applied to the brick along a vertical axis by said groove retaining tab, to thereby retain the brick against the panel.

20 Claims, 7 Drawing Sheets

Prior Art Thin Set Interior Finish Over Wallboard

U.S. PATENT DOCUMENTS

| | | | | | |
|---|---|---|---|---|---|
| 2,924,963 | A | | 2/1960 | Taylor et al. | |
| 2,938,376 | A | | 5/1960 | Workman et al. | |
| 3,005,293 | A | | 10/1961 | Hunter | |
| 3,321,883 | A | | 5/1967 | Pascucci | |
| 3,331,180 | A | | 7/1967 | Vissing et al. | |
| 3,387,422 | A | * | 6/1968 | Wanzer | 52/387 |
| 3,434,257 | A | | 3/1969 | Sakuma | |
| 3,520,095 | A | | 7/1970 | Jonason et al. | |
| 3,533,206 | A | | 10/1970 | Passeno, Jr. | |
| 3,908,326 | A | | 9/1975 | Francis | |
| 4,011,702 | A | | 3/1977 | Matyas | |
| 4,238,915 | A | * | 12/1980 | Yoshida et al. | 52/510 |
| 4,244,155 | A | | 1/1981 | Swiger | |
| 4,407,104 | A | | 10/1983 | Francis | |
| 4,407,107 | A | | 10/1983 | Smith, Jr. | |
| 4,641,473 | A | | 2/1987 | Trezza | |
| 4,662,140 | A | * | 5/1987 | Porter et al. | 52/385 |
| 4,736,552 | A | | 4/1988 | Ward et al. | |
| 4,773,201 | A | | 9/1988 | Trezza | |
| 4,809,470 | A | | 3/1989 | Bauer et al. | |
| 4,856,245 | A | | 8/1989 | Osawa | |
| 4,947,600 | A | | 8/1990 | Porter | |
| 4,987,712 | A | * | 1/1991 | Mancuso | 52/387 |
| 5,822,937 | A | * | 10/1998 | Mahony et al. | 52/366 |
| 6,408,585 | B1 | * | 6/2002 | Tajima | 52/506.06 |
| 6,802,165 | B1 | * | 10/2004 | Passeno | 52/387 |
| 2002/0184846 | A1 | * | 12/2002 | Crowder | 52/507 |
| 2003/0121225 | A1 | | 7/2003 | Hunsaker | |
| 2003/0213212 | A1 | | 11/2003 | Passeno | |
| 2004/0050003 | A1 | | 3/2004 | Passeno | |

* cited by examiner

Prior Art Thin Set Interior Finish Over Wallboard

Prior Art Thick Set Method Over Masonry

Prior Art Thick Set Method Over Steel Stud Framing

Prior Art Thin Brick Panel

Prior Art Steel Support for Thin Brick

1/2"
5/8"
3/4"
typ
9/16" typ 60 deg typ
1/8" typ 7-5/8"or
11-5/8"
typ
2-1/4"
3-5/8"
Dimensioal data for Endicott Thin Brick
Drawn by Chet Schwalenberg 4/10/2004

SUPPORT PANEL FOR THIN BRICK

The present application claims benefit of priority from U.S. Provisional Patent Application No. 60/567,059, filed Apr. 30, 2004.

FIELD OF THE INVENTION

The present invention relates to the field of support panels, and more particularly to a support panel adapted for supporting thin brick on a fascia, suitable for exterior architectural application

BACKGROUND OF THE INVENTION

Thin primarily brick functions as an architectural wall covering that has the low maintenance benefits of conventional brick masonry. Secondarily, thin brick will provide some protection to the material over which it is applied.

Thin brick, as well as architectural mounting systems therefore, are well known. Typically, a mounting panel, which may be a painted or galvanized steel sheet, is affixed to a vertical wall of a building, for example, over an environmental barrier and exterior grade plywood. The known mounting panels have ledges for the supporting the bottom of the thin brick. In this case, bricks are retained in place with an adhesive, designed to hold the thin brick until mortar is applied and sets.

The Brick Institute of America has issued Technical Notes 28C, Thin Brick Veneer—Introduction [January 1986] (Reissued January 2001), available at www.bia.org/BIA/technotes/t28c.htm. Thin brick are generically known as thin fired clay units, which are employed as interior or exterior wall coverings. Thin brick veneer is used in commercial, residential and do-it-yourself markets. Thin brick units are typically formed from shale and/or clay, and are kiln-fired. These thin brick units are much like facing brick (ASTM C 216), except they are approximately ½ to 1 in. (12 to 25 mm) thick. The face sizes are normally the same as conventional brick and therefore, when in place, give the appearance of a conventional brick masonry wall. ASTM C 1088 Thin Veneer Brick Units made from Clay or Shale covers two grades for exposure conditions to weather which are defined as Exterior and Interior. The three types of thin veneer brick are based on appearance and are defined as TBS, TBX and TBA. Minimum compressive strengths are not required in C 1088 as there is no way to test thin brick in compression.

In the early 1950's, the Structural Clay Products Research Foundation (now the Brick Institute of America) began the development of "SCR Re-Nu-Veneer", a ¾ in. (19 mm) thick fired clay unit which had Norman size nominal face dimensions (2⅔ in. by 12 in. [68 mm by 305 mm]). In addition to developing the thin units, the Foundation developed special clips to attach the units to an existing wall, mortar for grouting the joints and a power-driven grouting gun. Today, thin brick are being installed using a variety of procedures. In Japan and in the United States, thin brick have been placed into forms and cast integrally with concrete, thus providing a very attractive architectural precast concrete panel. Another procedure involves bonding thin brick to a 16 in. by 48 in. (406 mm by 1220 mm) substrate, resulting in small, lightweight, easily installed modular panels. Ceramic tile installation techniques are often used to install the brick units, either at the jobsite or on prefabricated panels, and homeowners are renovating with do-it-yourself thin brick products.

Thin brick are available in various sizes, colors and textures. The most commonly found face size is standard modular with nominal dimensions of 2⅔ in. by 8 in. (68 mm by 203 mm). The actual face dimensions vary slightly among manufacturers, but are typically ⅜ in. to ½ in. (10 mm to 13 mm) less than the nominal dimensions. The economy size unit is 50% longer and higher, with the same aspect ratio, with a face size of 4 in. by 12 in. (102 mm by 305 mm). Other sizes, such as Norwegian, 3-in. (76 mm), non-modular, oversize, etc., may be available.

There are several methods of thin brick installation. Adhered veneer relies on a bonding agent between the thin brick units and the backup substrate. Adhered veneer construction may be classified as either thin bed set or thick bed set. The thin bed set procedure typically utilizes an epoxy or organic adhesive, and is normally used on interior surfaces only. For areas subject to dampness, only clear and dry masonry surfaces or concrete surfaces should be used for backup. For dry locations, the backing material (substrate) may be wood, wallboard, masonry, etc. A cross-section depicting a wood frame wall upon which thin brick veneer (thin set procedure) is installed is shown in FIG. 1.

The thick bed set procedure is often used on interior and exterior surfaces. The backing material may be masonry, concrete, steel or wood stud framing. The thick bed setting procedure over concrete masonry is illustrated in FIG. 2. The wire lath shown in FIG. 2 may be eliminated if the masonry wall is heavily scarified (sand-blasted). (Williams, Griffith, Jr., "New Bricklike Tile Veneer", *Building Standards*, July-August, 1982). For applications over steel studs, procedures are similar to those used for concrete or masonry backup; however, wallboard and building felt must be installed over the studs before the lath and mortar bed are placed. Thick bed setting of thin brick over steel studs is shown in FIG. 3.

Prefabrication, utilizing thin brick veneer units, has been accomplished using the "casting" method. This process involves the combination of thin brick, grout and/or concrete cast into a prefabricated panel (similar to architectural precast concrete). This process requires the use of forms, a method of placing the units, and a system for grouting. The usual practice is to place the units face down into a form (or waffle mold), and place a very fluid grout over the back surface of the units. The grout flows into the space between the units, thus forming the appearance of mortar joints. Concrete and reinforcement are placed over the grout to provide structural support.

Modular panels are produced by several different companies and each system differs slightly. Basically, thin brick units are adhered to modular panels in the factory, or at the jobsite. The modular panels have dimensions of approximately 16 in. by 48 in. (406 mm by 1220 mm), as shown in FIG. 4. The backing materials to which the brick units are adhered may consist of polystyrene, polyurethane, cementitious board, asphalt-impregnated fiber board, plywood, aluminum, or a combination of these materials, depending on the manufacturer.

The panels weigh approximately 35 lb (16 Kg), which is light enough for one person to handle easily. Installation techniques vary only slightly among the different manufacturers. The head and bed joints between the thin brick units may be grouted after the panels are secured to the supporting wall.

Key-Lok Thin Brick Systems, Inc. produces a steel panel adapted for supporting thin brick. See, www.key-lok.com. The Key-Lok Thin Brick Siding is a mechanical support and spacing system that is based on an architectural grade galvanized steel pan specifically designed for the application of thin brick veneers. The Key-Lok support panels are 16" inches high and 48" inches in length. The Key-Lok thin brick system is a 4 component system, comprising a mechanical support and spacing system (the galvanized steel sheet), the brick, the mortar, and an adhesive to secure the brick to the steel sheet.

The Key-Lok system provides "brick keys" that, when encapsulated into the mortar, perform the function of seven to eight brick ties per brick. These keys are present at the lower edge of the thin brick as a support, and within the mortar on the upper edge. "Adhesive keys" allow the brick to "form mechanical adhesion to the metal rather than 'stuck' to the metal". These are indentations or slots in the steel, behind the brick, which therefore provide an adhesion strength dependent on the tensile strength of the adhesive, and not the strength of the bond between the adhesive and the steel. Each brick unit or piece is supported by and spaced with a support key ledge that is designed into the steel pan. A mechanical lock for the mortar and adhesive is provided for adherence. When the mortar and adhesive keys into these locks, each brick is permanently locked to the metal panel.

The thin brick support system may be mounted on various substrates, such as Orientated Strand Board (OSB), Exterior Grade Plywood, Exterior Grade Gypsum Sheathing, Block, Brick, Concrete and other sound substrates. Sheathing substrates may require a secondary weather resistive barrier such as Tyvek™ environmental barrier. The Key-Lok metal support pan has horizontal stiffening channels which add rigidity, allow for mechanical attachment, and create a chamber behind the system for water drainage and airflow. The metal support pan is approximately 0.012 in thickness and is designed as an architectural acceptable and commercial grade product, galvanized to a G-90 rating.

In order to mount the steel support pan, for wood frame construction, corner panels are required, which are installed before the regular flat panels. A benchmark is determined, and all measurements aligned with the benchmark, to assure level course of brick. A gap of ⅛" to ¼" of provided for thermal expansion. The panel is installed flat and tight to the supporting substrate, using non-corrosive fasteners, such as self tapping galvanized screws for steel studs, #8 coated deck screws for wood studs, and Tapcons, powder actuated or air actuated gun fasteners for masonry. Each panel has a "starter ledge" that rests on the brick supports of the panel below. Vertical joints are typically staggered on adjacent columns. The fasteners are placed in the channels, at a rate of about one per square foot, with an 8" vertical spacing (stud spacing horizontally) preferred on stud walls.

In order to mount the thin brick, adhesive is applied horizontally on the upper portion of the metal brick tracks along the adhesive locks. A ¼" bead is applied, leaving 2 inch gaps every 12" to 18" for moisture drainage. In most cases, corner bricks are to be installed first. Measurements are made for layout and to assure fit and brick spacing. Brick joints can be adjusted ±⅛", allowing a ¾" adjustment along a 40 foot wall. The mortar lock keys support the bricks. To ensure adhesion, the brick is nestled into the adhesive, breaking any "skin" that may have developed. The Key-Lok Mortar is a premixed product that comes in a bag, and requires the addition of clean potable water only. A Grout bag (a.k.a. Pastry bag) with a #5 tip is used to install the mortar into the joint. The mortar joint is fully filled so the mortar will grab the mortar key locks incorporated into the pan. The grout is squeezed into the bed (horizontal) joints first, starting at the top of the wall, with continuous movement. The joints are over-filled. The head (vertical) joints are then filled. Care is exercised to avoid getting excess grout on the face of the brick, since this is cosmetically unattractive, and therefore requires removal. When the mortar joints have become firm, thumb print dry, they are then pointed up with a metal brick jointing tool. Excess mortar is raked out, and the edges around brick compacted and sealed. The mortar is then striked with a commercially available tool, to compress the mortar into the joint and remove excess.

Another thin brick mounting system is the EZ Wall® Panel System, from American Brick Company, Detroit Mich. The system includes the EZ Wall® galvanized panel, mastic glue, and mortar for the joint. Similar to the Key-Lok system, bricks are supported by tabs in the mortar space, and initially held to the panel with adhesive, although the panel itself is flat with perforations and tabs extending perpendicularly from the plane of the panel. The panel is formed of 29 gauge, zinc coated galvanized to G-90 Commercial Grade coating protection, in four foot square panel sizes. The Insulok® system, also from American Brick Company, is similar, providing continuous ledges for the thin brick. See, www.ambrico.com/products.htm.

U.S. Pat. Nos. 5,501,049 and 5,373,676 each discloses a thin brick mounting system in which individual brackets are provided for each brick, supporting the brick and the bottom, with a dovetail retainer of a relatively thick panel retaining the top edge.

U.S. Published Patent Application No. 2003/0213212 discloses a thin brick mounting system in which a dovetail retainer of a relatively thick panel retains both the top and bottom edge of the thin brick.

U.S. Published Patent Application 2003/0121225 and U.S. Pat. Nos. 5,311,714, 5,228,937, and 4,947,600 each provides a thin brick mounting system in which a ledge is formed for supporting the brick on a lower edge thereof.

U.S. Published Patent Application 2004/0050003 and U.S. Pat. Nos. 6,098,363 and 3,321,883 each disclose a thin brick mounting system in which a panel has a set of retaining tabs formed thereon, each retaining tab both supporting a thin brick above and locking a top edge of a grooved brick below.

U.S. Pat. Nos. 2,832,102 and 5,390,457 each discloses a support panel for a specially contoured brick or tile, providing an interlocking structure which reduces the amount of mortar employed.

U.S. Pat. No. 4,662,140 provides a masonry or brick support panel having a set of ledges for supporting the lower edge of the brick, with adhesive strips supported by tabs protruding from the sheet to retain the brick to the panel.

U.S. Pat. Nos. 6,164,029, 4,890,433, 4,856,246, 4,238,915, 2,082,241, and 2,022,363, and each provide a tile or slabstone mounting panel with protrusions extending from the rear of the panel into a deep recess or recesses in the rear of the tile. This recess is, for example one quarter, one half, or more, of the time thickness, and the angle of the support is, for example, about 45 degrees.

U.S. Pat. Nos. 5,379,561, 4,987,712, and 3,005,293 each discloses a bracket system for retaining a wall panel, at the top and bottom edges, through a groove formed in each.

SUMMARY OF THE INVENTION

The present invention provides an improved steel support sheet for supporting architectural thin brick. The process and procedure is generally similar to the system and process described above with respect to the Key-Lok system, except as noted. Of course, other process and procedures, or variants thereon, may be employed in using the support sheet according to the present invention.

In contrast to the prior art, the present invention is adapted to employ a brick which has a shallow channel or indentation with an acute angle top edge in the rear. This channel engages a diagonally upward protruding extension of the support sheet, thus providing a torque which retains the thin brick against the support sheet. Therefore, in contrast to the prior art, the use of adhesive is not critical for affixing the thin brick to the support prior to grouting, and no bottom support ledge is required. This channel is, for example, less than one quarter the thickness of the brick, and preferably about one eighth inch deep. This depth allows a shallow angle tab to support the brick, which then employs principally the compression strength of the panel material and not the resistance to bending, to support the brick. Thus, in contrast to deeply grooved tiles according to the prior art, the support may be a simple perforated and indented shape, and need not have a complex profile to engage a groove or recess. In addition, the mortar space tab acts as a mortar lock.

The panel may also have a tabs that hook into an adjoining dovetail.

Thus, the adhesive becomes less critical in the process, and therefore, if used, may serve a different function. For example, the adhesive may be selected for low cost or high availability, long cure time to allow repositioning of brick, or the like. On the other hand, the thin brick is held to the support by the force of a steel arm against a recess in the brick, for example a dovetail, rather than the tensile strength of an adhesive. Installation is simplified, since the thin brick may be temporarily held in place or repositioned (assuming any adhesive has not cured), and may be tested prior to committing to placement. A suitable adhesive is PL-200® Construction Adhesive.

A preferred source for the thin brick with recess is Endicott Clay Products Co., Fairbury, Nebr. The brick is produced, for example, through an extrusion process, with a die producing a brick having the desired cross section including the recess, which is, for example, a dovetail about 2 mm below the rear face of the brick. Advantageously, a symmetrical pair of dovetails is provided in the upper and lower half of the brick, allowing the arm of the support sheet to engage above the center of gravity of the thin brick, without concern for a "top" and "bottom" of a brick.

Typically, thin brick is extruded in blocks which result in more than one brick per cross section, for example, 4 bricks, and in a continuous or long section. Surface texture and/or coloration may be applied to the structure in this state. The cross section of this structure is shown in FIG. 6. The quad thin bricks are then vitrified in a kiln. The thin bricks are then separated by fracture, to produce a single thin brick as shown in FIG. 7.

The preferred brick for use with the support therefore has a dovetail groove on the backside of the brick. The support panel has an upwardly protruding tab or claw, which engages the groove, to support the brick. Because of this supporting structure, a supporting ledge is not required below the thin brick. However, advantageously, as set of tabs are provided which protrude into the joint space, which may advantageously be at an opposite angle to the support tab, i.e., downwardly facing. In this configuration, a tensile force withdrawing the brick from the support causes a compression of the cured mortar against the edge of the brick, impeding movement. Thus, in contrast to a simple horizontal ledge, i.e., at right angles to the plane of the support panel, the present invention provides a structure which tends to employ the strength of the mortar to hold the thin brick in place. The tabs thus form a mechanical lock.

It is therefore an object of the present invention to provide a thin brick panel mounting system in which the initial placement of the thin brick on the panel is not dependent on an adhesive. Therefore, the brick is supported by at least two points displaced along a vertical axis, such as the upper and lower edge, or lower edge and a rear groove. It is noted that the lower edge support in the later case need only be the flat surface of the panel, since the groove support induces a rearward torque at the lower corner of the brick.

It is another object of the present invention to provide a thin brick mounting panel which is efficient and simple in design, yet provides secure retention of thin brick against the panel during installation and thereafter.

According to another aspect of the invention, the placement of perforations may be in a simple regular array, for normal walls, or in a custom pattern, for edges, doorways, patterns and visual designs, and the like. Preferably, custom designs are formed using a numerically controlled punch, based on output from a design program programmed to produce a pattern which corresponds to a desired end result. Advantageously, the panel, either prior to or after punching, may be printed, for example using a lithograph, silk screen, ink jet technology, laser marking, or the like, with the custom pattern, to facilitate on-site assembly without error.

The numerically controlled punch is preferably produces a semicircular tab, which has an angle of +18 degrees for the groove retaining tab and −83 degrees for the mortar space tab.

The technologies provided herein may be used in a consistent manner with known devices and methods. Thus, for example, a high solids adhesive mastic may be used, even if not strictly necessary. Likewise, the panel need not be planar, and may therefore include recesses. However, according to a preferred embodiment of the present invention, the groove retaining tab is the principal mounting element, and therefore a shelf is preferably not provided immediately below the brick, since this might reduce the retaining torque on the brick.

These and other objects will become apparent through a review of the drawings and detailed description of the preferred embodiments.

BRIEF DESCRIPTION OF THE DRAWINGS

FIGS. 9A and 9B shows a front view of a partially constructed panel, and a side view, having thin brick installed on the panel of FIG. 8.

DETAILED DESCRIPTION OF THE PREFERRED EMBODIMENTS

As discussed above, various means are known for applying thin brick to a wall. Older methods employ a preform or apply the thin brick using adhesive to initially position the thin brick while the mortar sets. See FIGS. 1-4.

Figure 1:
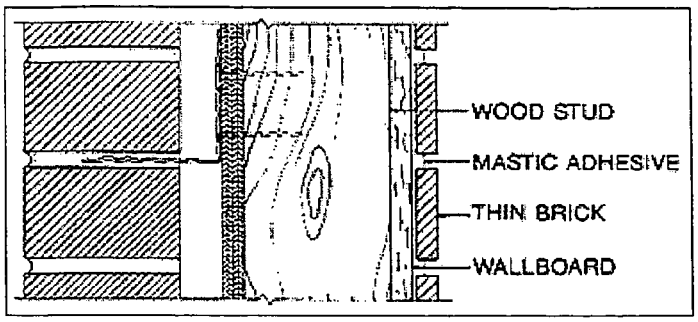
FIG. 1 shows installation of prior art thin set interior finish over wallboard
Figure 2:
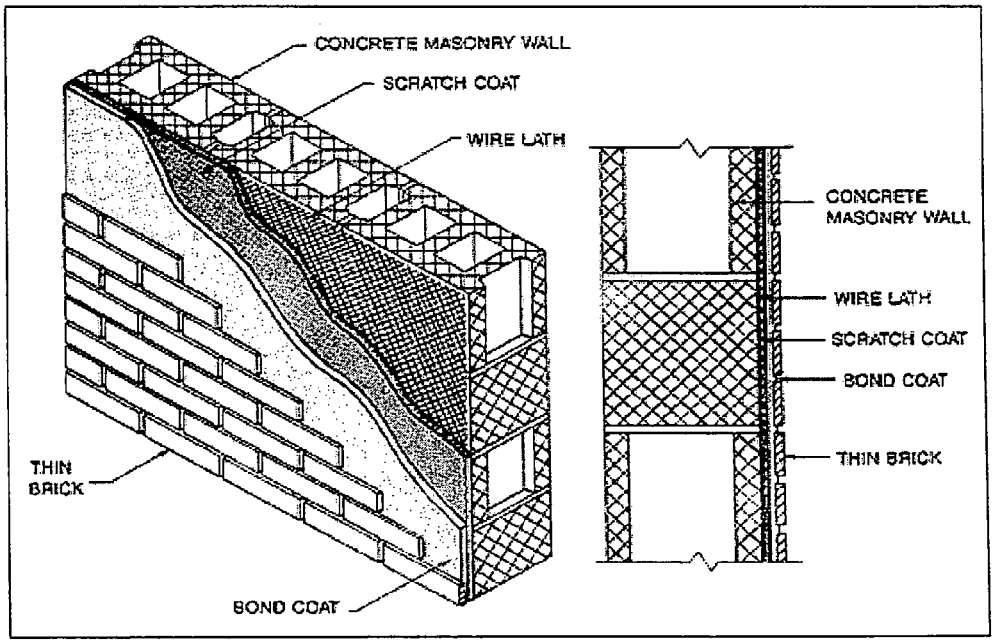
FIG. 2 shows installation of prior art thick set method over masonry
Figure 3:
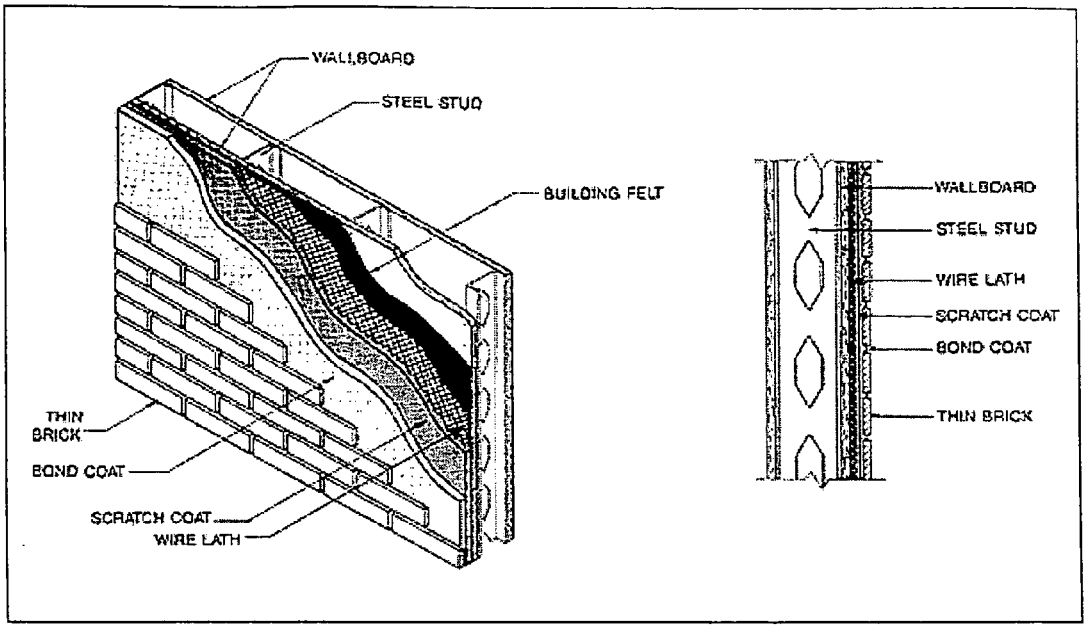
FIG. 3 shows installation of prior art thick set method over steel stud framing
Figure 4:
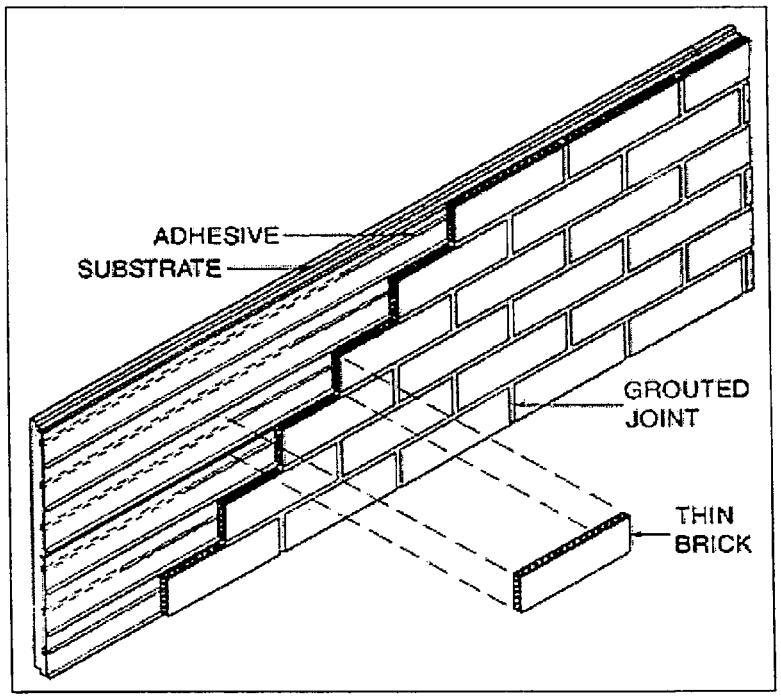
FIG. 4 shows installation of prior art thin brick panel
Figure 5:
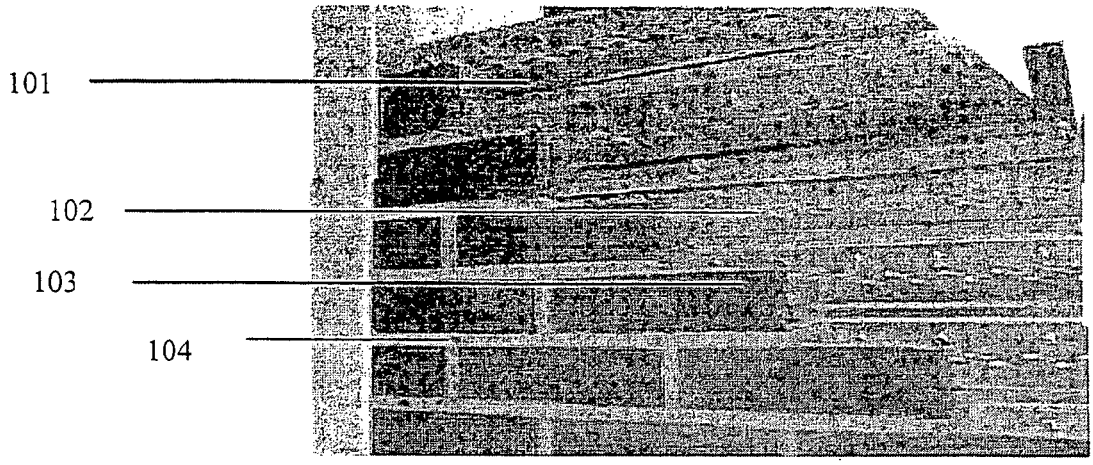
FIG. 5 shows installation of prior art steel support for thin brick

Newer methods employ a panel to support the thin brick, for example the Key-Lok system shown in FIG. 5, which provides a panel 101 having a brick shelf and adhesive recesses, on which an adhesive 102 is placed, and then the thin brick 103 and mortar are applied.

Figure 6A:
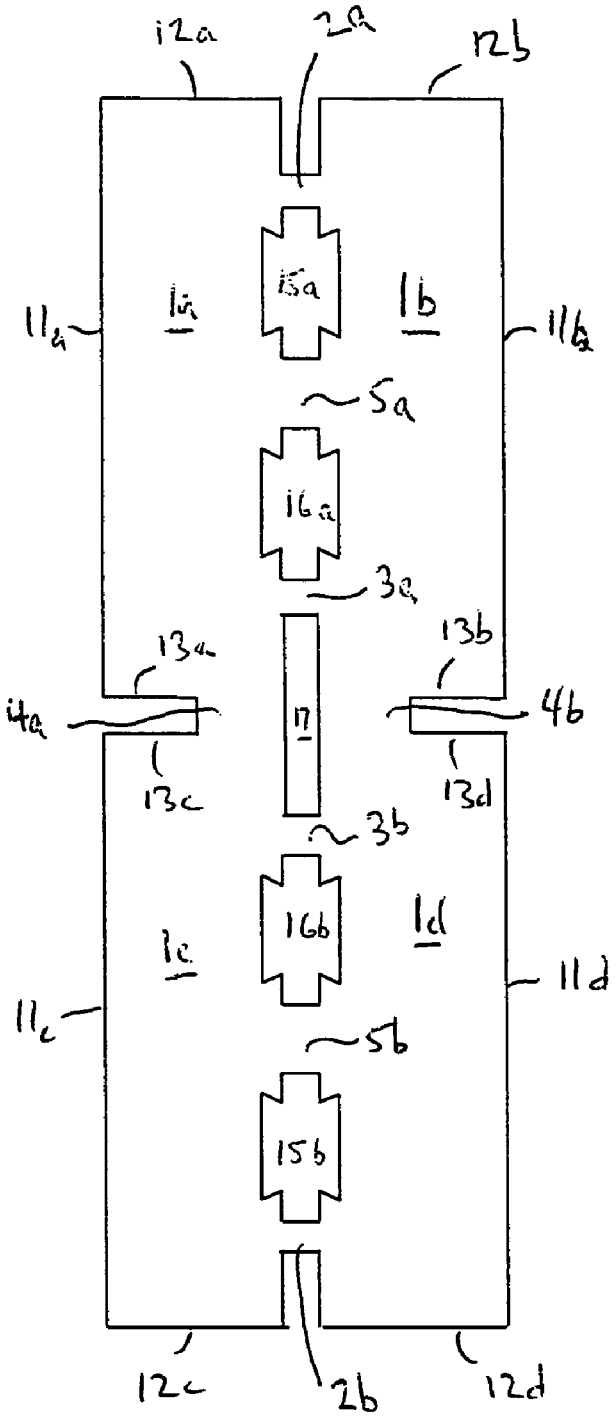
FIGS. 6A and 6B show cross sections, respectively, of an extruded quad-brick prior to separation and the resulting single brick.

A preferred embodiment of the present invention employs a thin brick, for example available from is Endicott Clay Products Co., Fairbury, Nebr., which advantageously has a groove formed in the rear. The thin brick is extruded in a generally continuous process, providing a cross section as shown in FIG. 6A. The quad bricks are then wire cut to length. In this configuration, an aesthetic treatment may be applied to the exterior surfaces only, of four bricks, which are then vitrified in a kiln. The extrusion die forms the four bricks, 1*a*, 1*b*, 1*c*, 1*d*, having faces 11*a*, 11*b*, 11*c*, 11*d*, outer edges 12*a*, 12*b*, 12*c*, 12*d*, inner edges 13*a*, 13*b*, 13*c*, 13*d*, as well as internal features, including outer keystone (dovetail) grooves 15*a*, 15*b*, inner keystone (dovetail) grooves 16*a*, 16*b*, and central space 17.

Figure 6B:
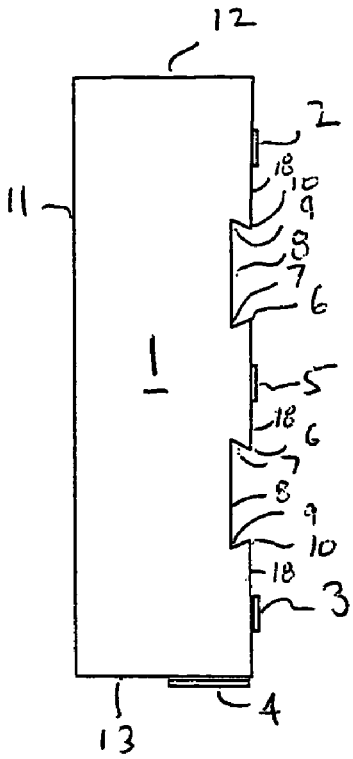
Figures 7A, 7B, 7C, 7D:
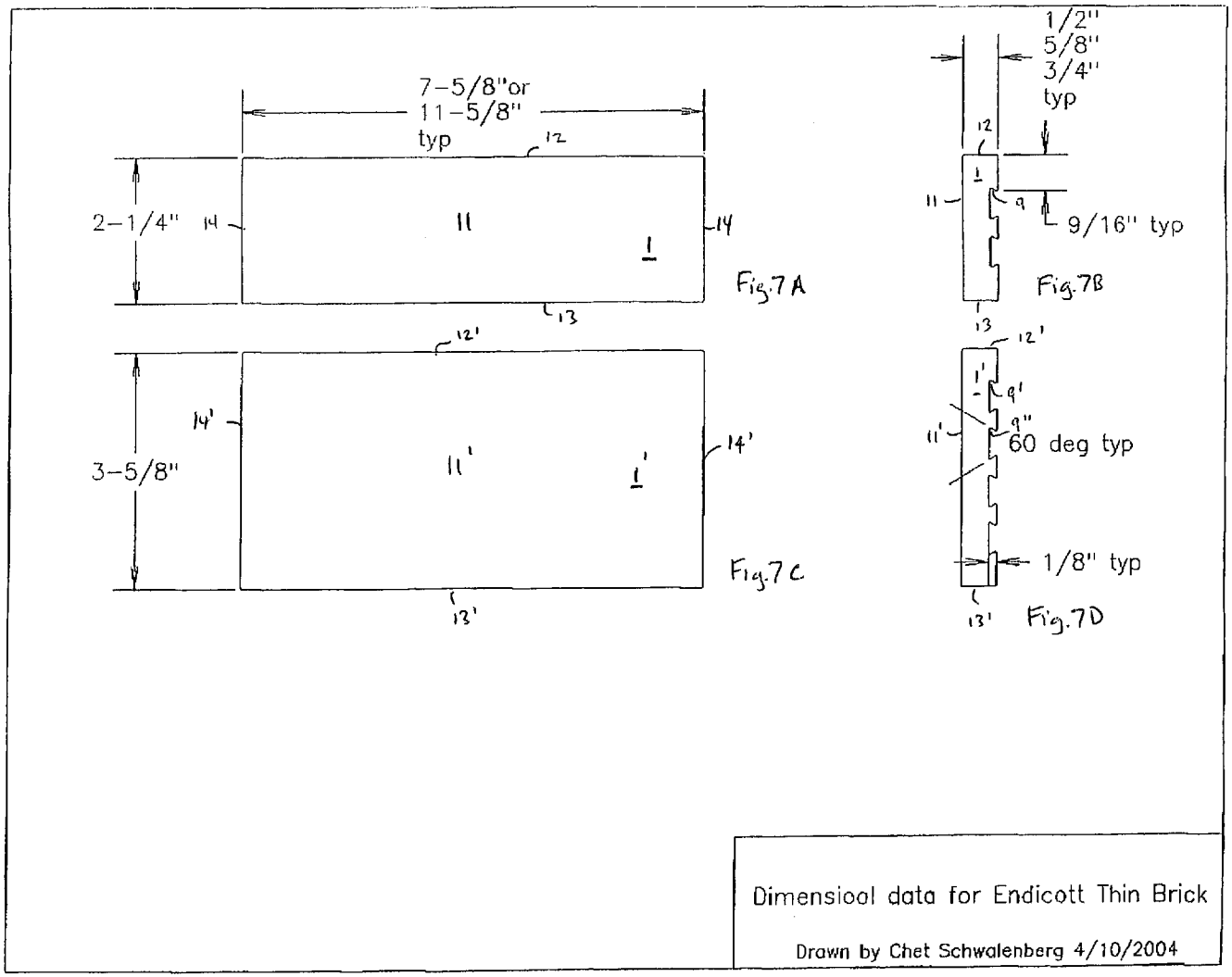
FIGS. 7A, 7B, 7C and 7D show, respectively, front and side views of a 2¼ and 3⅝ high thin brick having a dovetail groove on the rear face thereof.

The terminal faces 14 (shown in FIG. 7A) of the brick are formed by a wire drawn through the clay or shale material. The brick is then fired in a kiln, until it is vitrified. The quad brick structure is then separated by fracture, after surface treatments are applied to the exterior surface, at bridges 2*a*, 2*b*, 3*a*, 3*b*, 4*a*, 4*b*, to produce four single bricks as shown in FIG. 6B.

The final thin brick 1 has an outer face 11, upper and lower edges 12, 13, the remains of bridges 2, 3, 4, and two dovetail grooves horizontally along the rear surface. These grooves each have a planar central portion 8, an acute angle wall 7, 9, defining a restricted opening as compared to the central portion 8, and an inner tip 6, 10 where the acute angle wall 7, 9 intersects the rear plane of the brick 18.

As shown in FIGS. 7A, 7B, 7C and 7D, the brick may be in a number of sizes, for example, 2¼" nominal and 3⅝" nominal, with thicknesses of ½", ⅝", or ¾". As shown, the typical angle for the dovetail groove walls is about 60 degrees, with a ⅛" depth for the central portion.

Figure 8:
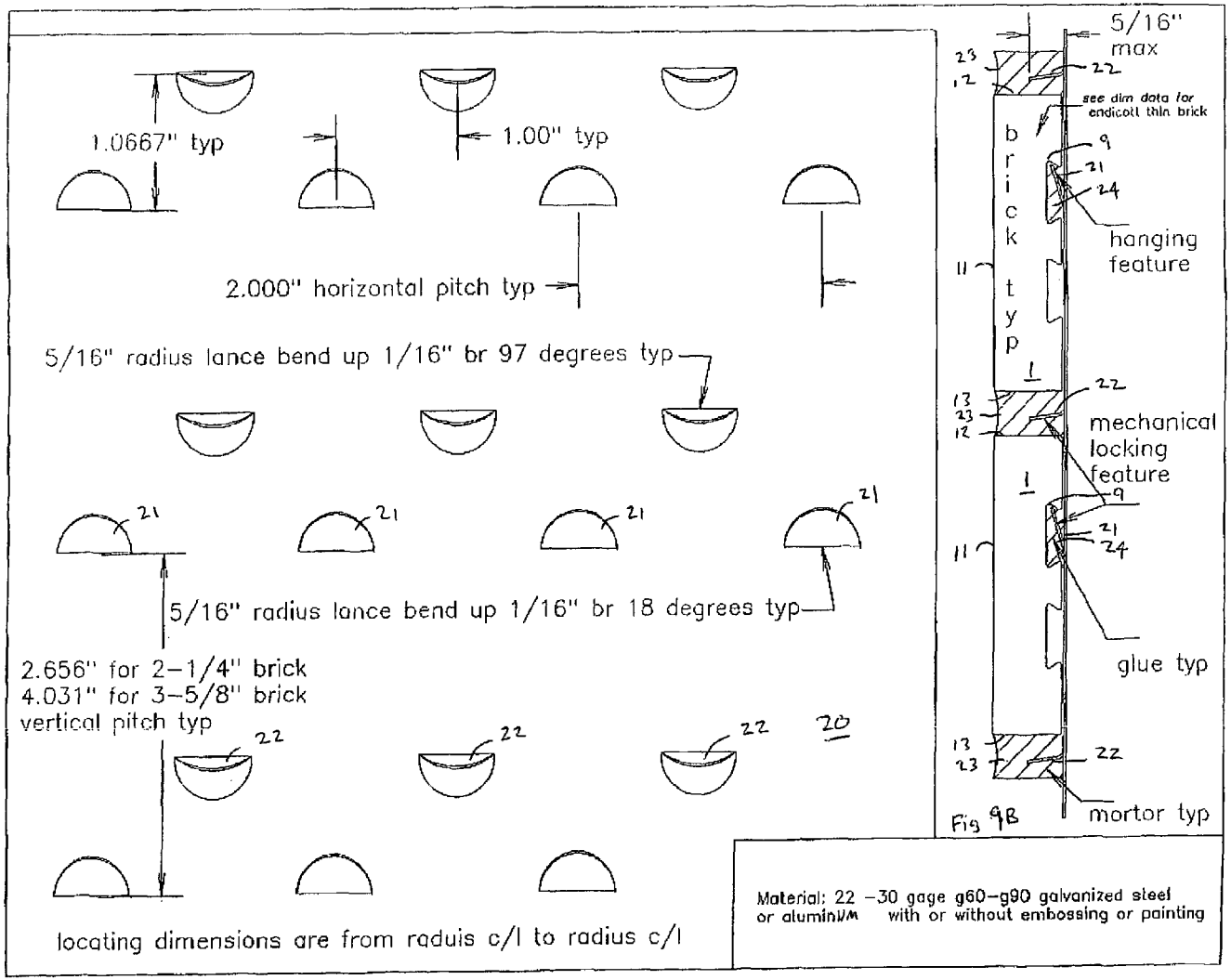
FIG. 8 shows a front view of a support panel in accordance with the present invention.

As shown in FIG. 8, a regular array of punched tabs is provided on a sheet 20, which is, for example, 22-30 gauge steel, zinc coated galvanized to G-60 to G-90 Commercial Grade coating protection, or aluminum. The sheet may be embossed or painted, as desired. Typical sheet sizes are 47 15/16" wide by 47¾" tall.

A set of groove retaining tabs 21, are provided, 5/16" radius, bent up about 18 degrees (bend radius 1/16")), with the opening on the top, spaced 2" horizontal and vertically spaced 2.656" for 2¼" nominal brick and 4.031" for 3⅝" nominal brick. A set of mortar space tabs 22 are provided, 5/16" radius, bent up about 83 degrees (bend radius 1/16")), with the opening on the bottom (97 degrees with respect to groove retaining tab 21 baseline), spaced 2" horizontal and vertically spaced 2.656" for 2¼" nominal brick and 4.031" for 3⅝" nominal brick. The groove retaining tabs 21 and mortar space tabs 22 are displaced 1" horizontally and 1.0667" vertically (between groove retaining tab 21 and mortar space tab 22 for a respective upper mortar space 23).

Figure 9A:
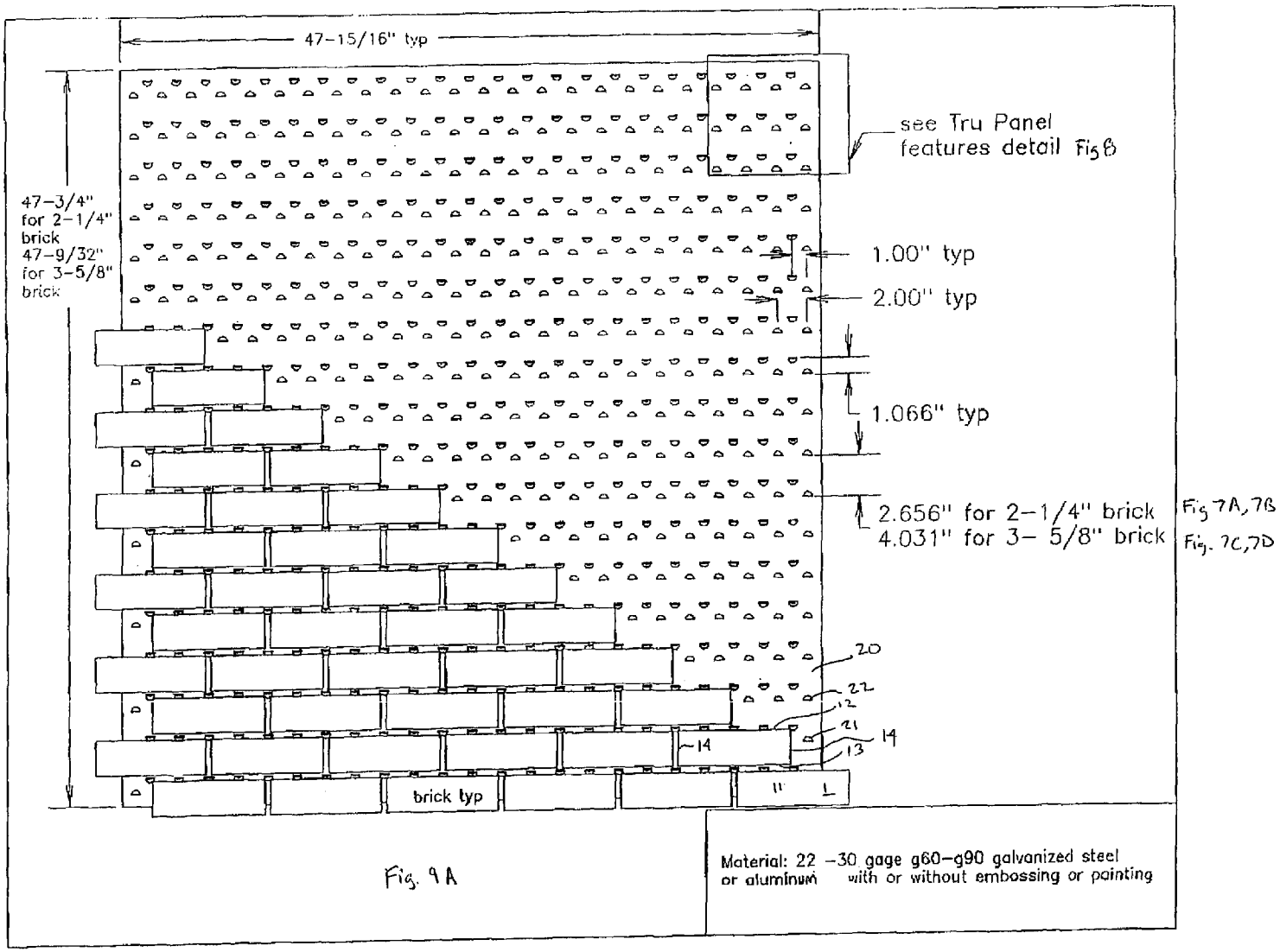

As shown in FIG. 9A, thin brick 1 is placed such that the groove retaining tabs 21 support the thin brick 1 at the acute angle wall 9 of the dovetail groove. As shown in FIG. 9B, Preferably, during the mortar process, mortar is forced into at least the upper dovetail groove 24, as well as the space between courses of brick 23. After the mortar is hardened, any tensile force on the brick 1 seeking to draw it away from the panel 20, will cause a compressive force between the groove retaining tabs 21, acting on the acute angle wall 9, and the mortar space tab 22, acting through the hardened mortar 23 on the upper edge of the brick 12. To unseat the brick, either the mortar 23, 24 must disintegrate, or the metal tabs 21, 22 must fail.

In order to facilitate filling the space near the groove retaining tab with mortar, the tab extends deeper than the recess in the thin brick, forming a gap behind the upper side of the brick, and thereby maintaining a pathway for the mortar to enter the space 24.

Therefore, it can be seen that the present design provides a mechanical retention of the brick to the support panel, independent of an adhesive, and thus is advantageous. An adhesive may be used if desired, but this adhesive is not critical, and therefore may be selected to facilitate installation, rather than for its long-term properties.

While the above detailed description has shown, described and pointed out the fundamental novel features of the invention as applied to various embodiments, it will be understood that various omissions and substitutions and changes in the form and details of the system and method illustrated may be made by those skilled in the art, without departing from the spirit of the invention. Consequently, the full scope of the invention should be ascertained by the appended claims.

What is claimed is:

1. A support panel for thin brick, comprising:

(a) a metal sheet;

(b) an array of groove retaining tabs having first tab edges, said first tab edges protruding from said sheet having at an upward angle of less than about 45 degrees, for a distance of less than about one quarter inch; and (c) an array of mortar lock tabs having second tab edges, said second tab edges protruding from said sheet at a downward angle of greater than about 45 degrees, said array of mortar lock tabs being offset vertically from said array of groove retaining tabs, wherein, said array of groove retaining tabs are adapted to engage shallow dovetail grooves formed in the rear of thin bricks, and said mortar lock tabs are adapted, when embedded within a cured mortar matrix, to exert, in response to a tensile force away from said metal sheet, a force along a vertical axis, on the brick, in an opposite direction to a force applied to the brick along a vertical axis by said groove retaining tab, to thereby retain the brick against the panel.

2. The support panel according to claim 1, wherein the metal sheet comprises galvanized steel.

3. The support panel according to claim 1, wherein the metal sheet comprises aluminum.

4. The support panel according to claim 1, wherein said groove retaining tabs comprise forwardly deflected central portions of semicircular perforations in said sheet.

5. The support panel according to claim 1, wherein said mortar lock tabs comprise forwardly deflected central portions of semicircular perforations in said sheet.

6. The support panel according to claim 1, wherein said groove retaining tabs extend upward and forward at an angle of about 18 degrees.

7. The support panel according to claim 6, wherein said mortar lock tabs extend downward and forward at an angle of about 83 degrees.

8. The support panel according to claim 1, wherein said metal sheet comprises galvanized steel, said groove retaining tabs and mortar lock tabs comprise deflected central portions of semicircular perforations having a radius of about 5/16 inch, said groove retaining tabs extending upward and forward at an angle of about 18 degrees and said mortar lock tabs extending downward and forward at an angle of about 83 degrees.

9. The support panel according to claim 1 in combination with a thin brick having formed on a rear face thereof a dovetail groove having a depth less than about one quarter the thickness of the brick.

10. The support panel according to claim 9, in combination with a mortar adapted for filling a space between adjacent bricks and curing to a solid material.

11. The support panel according to claim 1, further comprising a plurality of thin bricks having a shallow dovetail groove formed in a rear surface thereof, the shallow dovetail groove having a rear wall and two diverging sidewalls, mounted on said array of groove retaining tabs with gaps therebetween such that the first tab edges are seated within the upper inclined edge of the shallow dovetail grooves formed in the rear of the thin bricks and the mortar lock tabs are disposed in gaps between adjacent rows of thin bricks; and a curable mortar filling the gaps between the thin bricks to thereby encase the mortar lock tabs, wherein in response to a tensile force away from said front surface, the mortar lock tabs exert a downward force component, to thereby counter an upward force component exerted by the first tab edges acting on the shallow trapezoidal grooves.

12. The support panel according to claim 11, wherein the panel comprises a set of markings defining a thin brick placement pattern, wherein the plurality of thin bricks are placed on said array of groove retaining tabs in accordance with the thin brick placement pattern.

13. The support panel according to claim 11, wherein the panel comprises galvanized steel, said groove retaining tabs and mortar lock tabs comprise deflected central portions of semicircular perforations having a radius of about 5/16 inch, said groove retaining tabs extending upward and outward at an angle of about 18 degrees and said mortar lock tabs extending downward and outward at an angle of about 83 degrees.

14. The support panel according to claim 11, wherein said first tab edges, and second tab edges protrude from said metal sheet from a same side thereof.

15. A support panel for thin brick, comprising;

(a) a metal sheet having a front surface and a rear surface;

(b) an array of groove retaining tabs having first tab edges formed in said metal sheet, said first tab edges protruding from said front surface of said sheet at an upward angle of less than about 45 degrees, for a distance of less than about one quarter inch; and (c) an array of mortar lock tabs having second tab edges formed in said metal sheet, said second tab edges protruding from said front surface of said sheet at a downward angle of greater than about 45 degrees, said array of mortar lock tabs being offset vertically from said array of groove retaining tabs, said first tab edges being adapted to engage an upper edge of a shallow dovetail groove formed in the rear of a thin brick, and said second tab edges being adapted to be embedded within a cured mortar matrix between adjacent rows of thin brick, to exert on the thin brick, in response to a tensile force along an axis away from said front surface, a force having a downward component along a vertical axis, to thereby counter a force having an upward component along a vertical axis exerted by the first tab edges acting on the shallow dovetail groove, to thereby tend to retain the thin brick against said front surface of said sheet.

16. The support panel according to claim 15, wherein said groove retaining tabs comprise portions of said sheet deflected forward from semicircular perforations in said sheet.

17. The support panel according to claim 15, wherein said mortar lock tabs comprise portions of said sheet deflected forward from semicircular perforations in said sheet.

18. The support panel according to claim 15, wherein said groove retaining tabs extend forward and upward at an angle of about 18 degrees, and said mortar lock tabs extend forward and downward at an angle of about 83 degrees, with respect to a front surface plane of said sheet.

19. The support panel according to claim 15 in combination with a plurality of thin bricks having a thickness of less than about one inch, having formed on a rear face thereof a shallow dovetail groove having a depth less than about one quarter the thickness of the brick, and a mortar matrix composition filling a space between adjacent bricks and curing to a solid material.

20. The support panel according to claim 15, wherein metal sheet comprises a set of markings defining a thin brick placement pattern.

* * * * *